US008508158B2

(12) United States Patent
Cleland et al.

(10) Patent No.: US 8,508,158 B2
(45) **Date of Patent: *Aug. 13, 2013**

(54) HIGH-CURRENT DC PROTON ACCELERATOR

(75) Inventors: Marshall R. Cleland, Hauppauge, NY (US); Richard A. Galloway, East Islip, NY (US); Leonard DeSanto, Medford, NY (US); Yves Jongen, Louvain-la-Neuve (BE)

(73) Assignee: Ion Beam Applications S.A., Louvain-la-Neuve ( * ) Notice: Subject to any disclaimer, the term of this patent is extended or adjusted under 35 U.S.C. 154(b) by 0 days.

This patent is subject to a terminal disclaimer.

(21) Appl. No.: 13/408,069

(22) Filed: Feb. 29, 2012

(65) Prior Publication Data

US 2012/0161672 A1 Jun. 28, 2012

Related U.S. Application Data

(63) Continuation of application No. 12/539,347, filed on Aug. 11, 2009, now Pat. No. 8,148,922.

(60) Provisional application No. 61/087,853, filed on Aug. 11, 2008.

(51) Int. Cl.
*H05H 7/00* (2006.01)

(52) U.S. Cl.
USPC ..... 315/501; 315/500; 315/507

(58) Field of Classification Search
None
See application file for complete search history.

(56) References Cited

U.S. PATENT DOCUMENTS 8,148,922 B2 * 4/2012 Cleland et al. ..... 315/501

* cited by examiner

*Primary Examiner* — Anh Tran
(74) *Attorney, Agent, or Firm* — Christopher Casieri

(57) ABSTRACT

A dc accelerator system able to accelerate high currents of proton beams at high energies is provided. The accelerator system includes a dc high-voltage, high-current power supply, an evacuated ion accelerating tube, a proton ion source, a dipole analyzing magnet and a vacuum pump located in the high-voltage terminal. The high-current, high-energy dc proton beam can be directed to a number of targets depending on the applications such as boron neutron capture therapy BNCT applications, NRA applications, and silicon cleaving.

11 Claims, 9 Drawing Sheets

HIGH-CURRENT DC PROTON ACCELERATOR

CROSS-REFERENCE TO RELATED APPLICATIONS

This application is a Continuation of U.S. patent application Ser. No. 12/539,347 filed Aug. 11, 2009 now U.S. Pat. No. 8,148,922, of the same title, which claims priority to U.S. Provisional patent application No. 61/087,853, Aug. 11, 2008 the entire disclosures of which are incorporated herein by reference.

BACKGROUND OF THE INVENTION

1. Field of the Invention

The present invention relates to proton accelerators.

2. Description of Related Art

In the late 1920s and early 1930s, research in experimental nuclear physics was stimulated by the invention of several types of particle accelerators. These systems included the radio frequency (RF) drift-tube linear accelerator by Rolf Wideröe, the RF spiral-orbit cyclotron by Ernest Lawrence, the direct current (dc) cascaded-rectifier high-voltage generator by John Cockcroft and Ernest Walton, and the dc electrostatic high-voltage generator by Robert Van de Graaff. Approximately 600 Van de Graaff ion and electron accelerators were made by the High Voltage Engineering Corporation, which was founded in 1946 by several professors from the Massachusetts Institute of Technology (MIT). Those electrostatic systems were popular because of their ability to provide small-diameter, low-divergence particle beams with finely controlled energies. The ion sources were typically small, glass tubes containing plasmas excited by low-power RF generators. The proton beam current was limited to a few hundred microamperes, but this was usually sufficient for many research programs in nuclear physics.

Physicists and other scientists sought out accelerators that could provide higher beam currents for a variety of applications. For example, the U.S. National Aeronautics and Space Administration (NASA) sought accelerators that could provide higher proton beam currents to investigate the deleterious effects of the Van Allen radiation on satellites in space. Their need motivated the development of Dynamitron dc accelerators with Duoplasmatron type ion sources (M. von Ardenne, Tabellen der Electrophysik, Ionenphysik and Ubermikroskopie I,V.E.B. Deutcher Verlag der Wissenschaften, 544-549 (1956); C. D. Moak, H. E. Banta, J. N. Thurston, J. W. Johnson, R. F. King, Duoplasmatron Ion Source for Use in Accelerators, Rev. Sci. Instrum. 30, 694 (1959)). The modified Duoplasmatron ion sources developed by Radiation Dynamics, Inc. (RDI) were capable of emitting more than 10 mA of atomic, diatomic and triatomic ions obtained from hydrogen or deuterium plasmas (M. R. Cleland, R. A. Kiesling, Dynamag Ion Source with Open Cylindrical Extractor, IEEE Transactions on Nuclear Science, NS-14, No. 3, 60-64 (1967); M. R. Cleland, C. C. Thompson, Jr., Positive Ion Source for Use with a Duoplasmatron, U.S. Pat. No. 3,458,743, Patented Jul. 29, 1969.). (Recently, RDI's name has been changed to IBA Industrial, Inc.)

For another example, the fast-neutron cancer therapy system that was developed during the early 1970s by RDI, in cooperation with AEG Telefunken for the University Hospital Hamburg-Eppendorf in Germany, accelerated a 12 mA beam of atomic and molecular deuterium ions to an energy of 600 keV to produce a high-intensity source of 14 MeV neutrons ($>2\times10^{12}$ neutrons per second) from a rotating, tritium-coated target (M. R. Cleland, The Dynagen IV Fast Neutron Therapy System, Proceedings of the Work-Shop on Practical Clinical Criteria for a Fast Neutron Generator, Tufts-New England Medical Center, Boston, Mass., 178-189 (1973) and B. P. Offermann, Neutron-Therapy Unit for the Universitätskrankenhaus Hamburg-Eppendorf Radiologische Universitätsklinik, in the same Work-Shop Proceedings, 67-86 (1973).

However, the acceleration of a mixed beam of atomic and molecular hydrogen ions to higher energies (up to 4.5 MeV) in larger Dynamitrons was limited to only a few milliamperes. The collisions of energetic ions with residual hydrogen gas from the ion source, which was flowing through the longer acceleration tube, had the undesirable affect of producing unfocussed hydrogen ions and free electrons. Some of these unwanted ions and electrons were intercepted by intermediate dynodes, which distorted the voltage distribution along the acceleration tube. This effect led to unstable operation at higher beam currents. The free electrons produced by these collisions were drawn back toward the positive high-voltage terminal, where they generated X-rays. The X-rays produced ions in the high-pressure sulfur hexafluoride gas that was used to insulate the high-voltage generator. This effect was indicated by the dc current flowing from the high-voltage rectifier column to the RF electrodes which surrounded and energized the cascaded rectifier system, and it was verified by measuring the X-ray pattern outside of the pressure vessel. The generation of X-rays by free electrons within the acceleration tube was undesirable because it wasted high-voltage power and increased the radiation shielding requirements in the accelerator facility.

Further studies demonstrated that the ion current limitations described above could be alleviated by adding a titanium getter pump near the ion source to reduce the flow of hydrogen gas into the acceleration tube. An electrostatic einzel lens and a crossed electric and magnetic field mass analyzer were also added after the ion source to deflect the molecular hydrogen ions and prevent them from entering the acceleration tube (E. M. Kellogg, Ion-Gas Collisions During Beam Acceleration, IEEE Transactions on Nuclear Science, Vol. NS-12, No. 3, 242-246 (1965); M. R. Cleland, P. R. Hanley, C. C. Thompson, Acceleration of Intense Positive Ion Beams at Megavolt Potentials, IEEE Transactions on Nuclear Science, Vol. NS-16, No. 3, 113-116 (1969)).

However, high-energy dc proton accelerators, capable of providing more beam current than a few milliamperes, have not been developed previously. There are a number of very important applications that require or could benefit from a high-current, high-energy dc proton accelerator. For example, applications such as boron neutron capture therapy (BNCT), the detection of explosive materials by nuclear resonance absorption (NRA) and the cleavage of silica for the production of thin silicon wafers, such as those used for solar cells, would benefit from an accelerator with such capabilities.

Despite the growing need for such an accelerator, previous attempts to develop a proton accelerator, with both high-current and high-power capabilities, have not been successful. A high-current, high-energy pulsed proton beam could be produced by using a radio-frequency quadrupole (RFQ) accelerator. Nevertheless, a dc proton accelerator would be more desirable because it is more efficient electrically, and it can produce a continuous beam, in contrast to the pulsed beam from an RFQ accelerator, A continuous dc beam can produce a more uniform dose distribution than a pulsed beam when it is scanned over a large area target. A dc accelerator can also produce a proton beam with less energy variation, which is important for NRA applications and for the production of thin silicon wafers.

SUMMARY OF THE INVENTION

A dc accelerator system able to accelerate high currents of proton beams at high energies is provided. The accelerator system includes a dc high-voltage, high-current power supply, an evacuated ion accelerating tube, a proton ion source, a dipole analyzing magnet and a vacuum pump located in the high-voltage terminal.

The dc accelerating system has an accelerating tube, often called the beam tube, with a plurality of conducting electrodes separated from each other by insulating rings. The accelerating tube is configured to provide a uniform and focusing accelerating electric field to the proton beam. The high voltage (preferably 0.4 MeV or more), high current (preferably 5 mA or more) power supply provides accelerating voltage to the accelerating tube. The ion source produces protons by ionizing hydrogen gas with microwave power supplied by an external microwave generator. The plasma is confined by an axial magnetic field established with permanent magnets that surround the source. The ion source has a small beam extraction aperture and provides high currents (preferably 5 mA or more) of proton beam while releasing small amounts (preferably less than 3 standard cubic centimeters per minute (sccm) of neutral hydrogen gas through the beam extraction aperture.

The accelerator system preferably includes components that reduce the deleterious effects of ion-gas collisions in the acceleration tube. The dipole analyzing magnet is located between the ion source and the accelerating tube. The field configuration of the analyzing magnet prevents ions other than protons produced by the ion source from reaching the accelerating tube. A vacuum sorption pump connected between the ion source and the accelerating tube may be included to reduce the amount of neutral hydrogen gas entering the accelerating tube. A small aperture may be placed at the entrance of the accelerating tube to limit the divergence of the beam to be accelerated and to further limit the amount of neutral gas entering the accelerating tube.

The high-current, high-energy dc proton beam can be directed to a number of targets depending on the applications. For example, for boron neutron capture therapy (BNCT) applications, the accelerated proton beam may be directed to either of two lithium-coated targets for the production of neutrons. One target may be mounted on a rotating gantry for treating cancer patients from different directions. The other may be mounted in a fixed location for treatments that do not require the use of the rotating gantry. A dipole magnet located on the axis of the accelerator will enable the operator to switch the beam from one target to the other. A magnetic quadrupole lens located inside the pressure vessel near the base of the acceleration tube is the first component of the complex beam transport system.

Alternatively, for NRA applications, different targets are used to generate gamma rays with suitable energies for exciting nuclides typically present in explosive materials.

Other aspects of the invention will be apparent to those of ordinary skill in the art in view of the disclosure provided herein.

BRIEF DESCRIPTION OF THE DRAWINGS

The following drawings are for illustrative purposes only and are not intended to limit the scope of the present invention in any way.

DETAILED DESCRIPTION

A dc accelerator system 1 able to accelerate high currents of proton beams at high energies is described. The proton beams of the invention have energies of at least about 0.3 MeV, and as high as 5 MeV at high to very high currents. At these energies, the proton accelerators produced according to the invention are able to accelerate proton beams at currents of at least about 5 mA, and as high as 100 mA while maintaining the energy of the beam.

The specific levels of the dc accelerator system 1 will depend on the intended application. For example, BNCT, energies in the range of 1.9 to 3.0 Mev are used, with beam currents of 10-20 mA. For detection of the detection of explosive materials by nuclear resonance absorption (NRA) is variable depending on the material being detected. For silicon cleaving of silicon block (for producing photovoltaic cells), currents as high as 15-25 mA, or even 30-40 mA, at energies around 4 MeV for producing thicker silicon wafers or 1 MeV or less for producing thinner slices.

Figure 1:
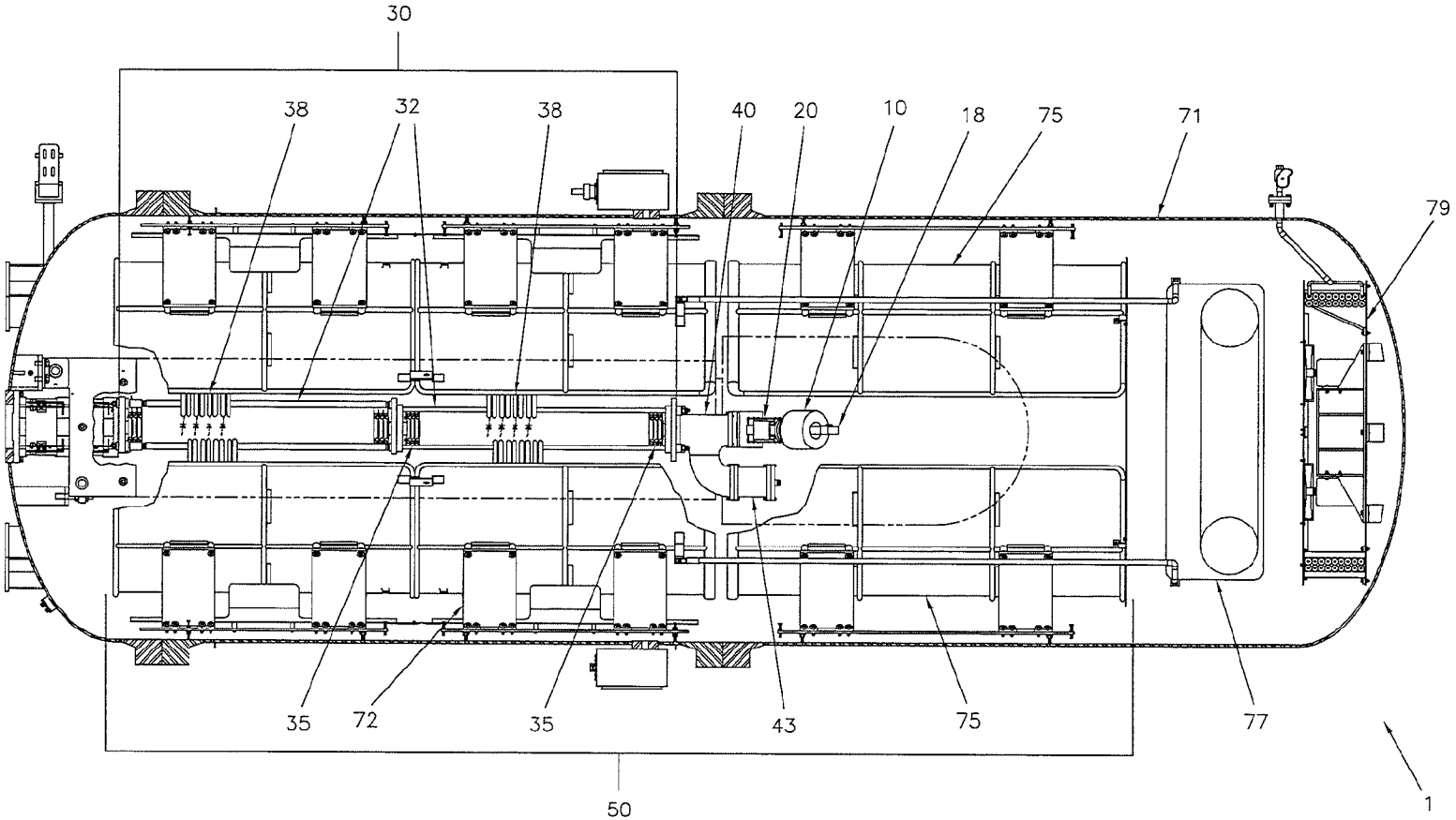
FIGS. 1 and 2 illustrate one embodiment of the high-current, high-energy dc proton accelerator.
Figure 2:
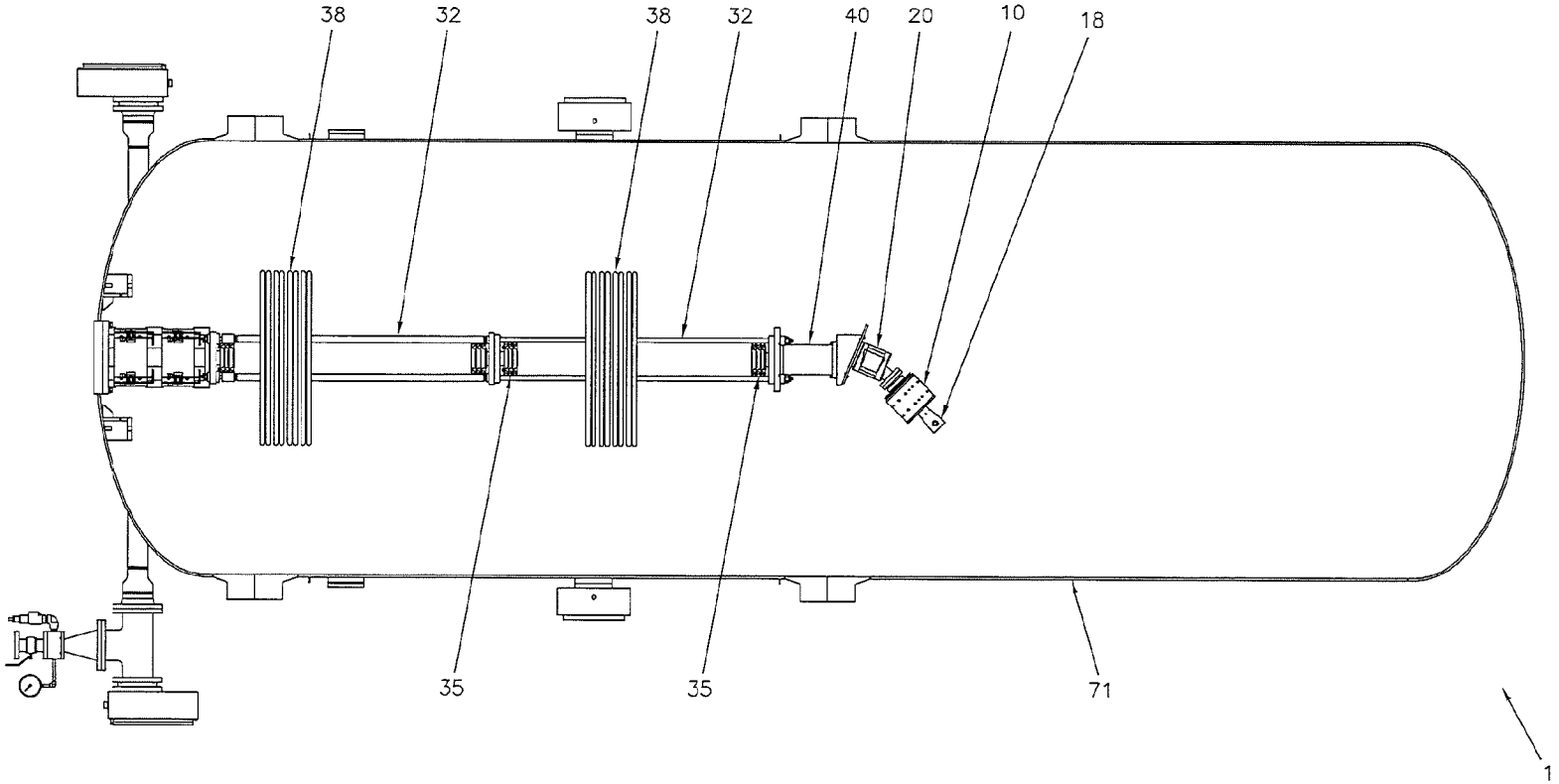

A description of the preferred embodiment is provided in FIGS. 1 and 2. FIGS. 1 and 2 illustrate the primary components of a dc accelerator system 1 able to accelerate high currents of proton beams at high energies. The dc accelerator system 1 includes a proton ion source 10 coupled to a do accelerating structure 30 via vacuum chamber 40. A dipole analyzing magnet 20 is positioned between the ion source 10 and the dc accelerating structure 30. The dc accelerating structure 30 is connected to a high voltage, high current (more than 5 mA) power supply 50 providing the accelerating voltage to the accelerating structure 30. The accelerating structure 30 exits to a beam focusing lens for controlling the beam shape for a particular application.

The major components are encased in a pressure vessel 71. As shown in FIG. 1, an accelerator vessel cooler 79, insulating supports 72 are illustrated. An RF high voltage transformer 77 and RF electrodes 75 are also illustrated. These components are not included in FIG. 2 in order to illustrate the proton ion source 10, dipole magnet 20, vacuum chamber 40, and the accelerating tube 32 of the accelerating structure 30.

Figure 3:
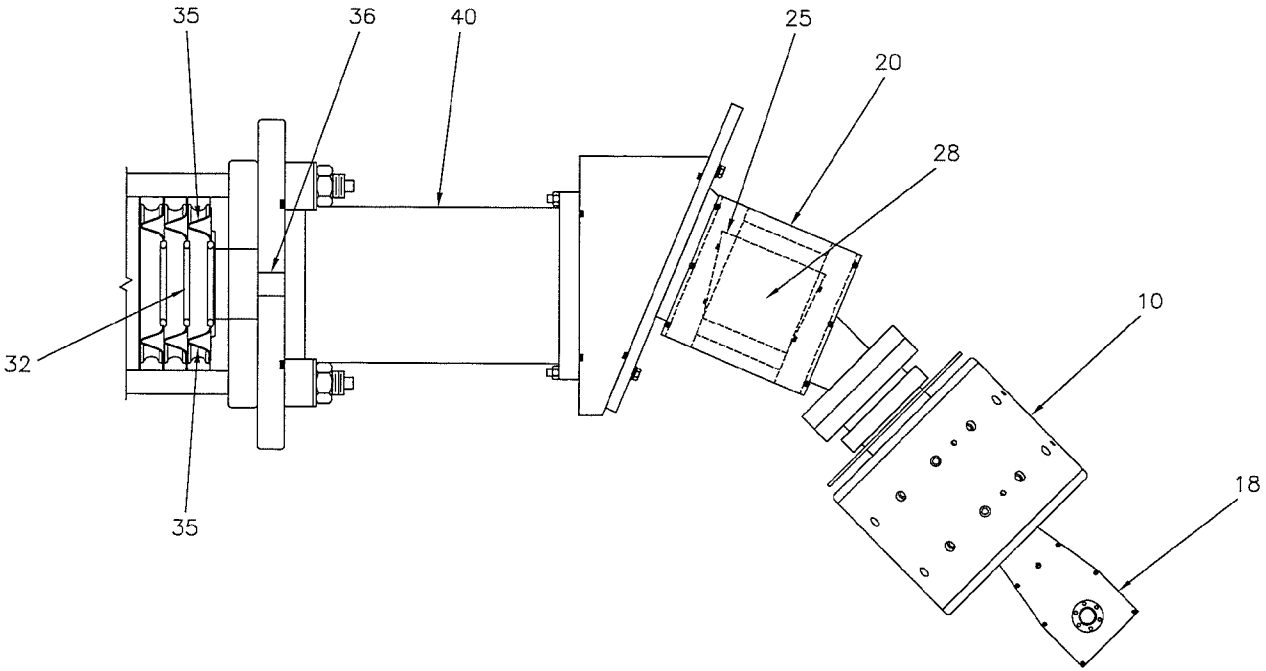
FIGS. 3 and 4 illustrate two views of an embodiment of the ion source, dipole analyzing magnet, vacuum chamber and entry of the accelerating structure of the high-current, high-energy dc proton accelerator.
Figure 4:
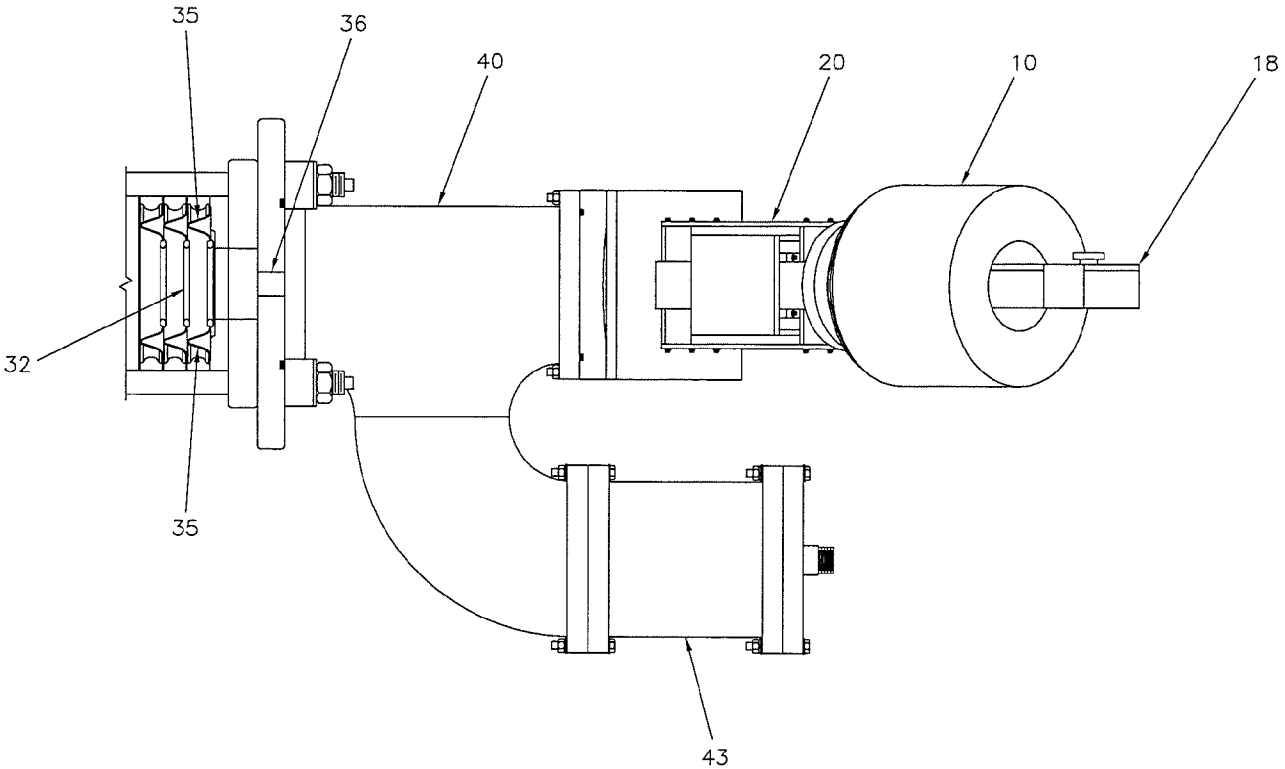

Two close up views of the proton ion source 10, dipole magnet 20, vacuum chamber 40, and the entrance of the accelerating tube 32 of the accelerating structure 30. is shown in FIGS. 3 and 4. FIGS. 3 and 4 show different views of the same components.

Proton Ion Source

Figure 5:
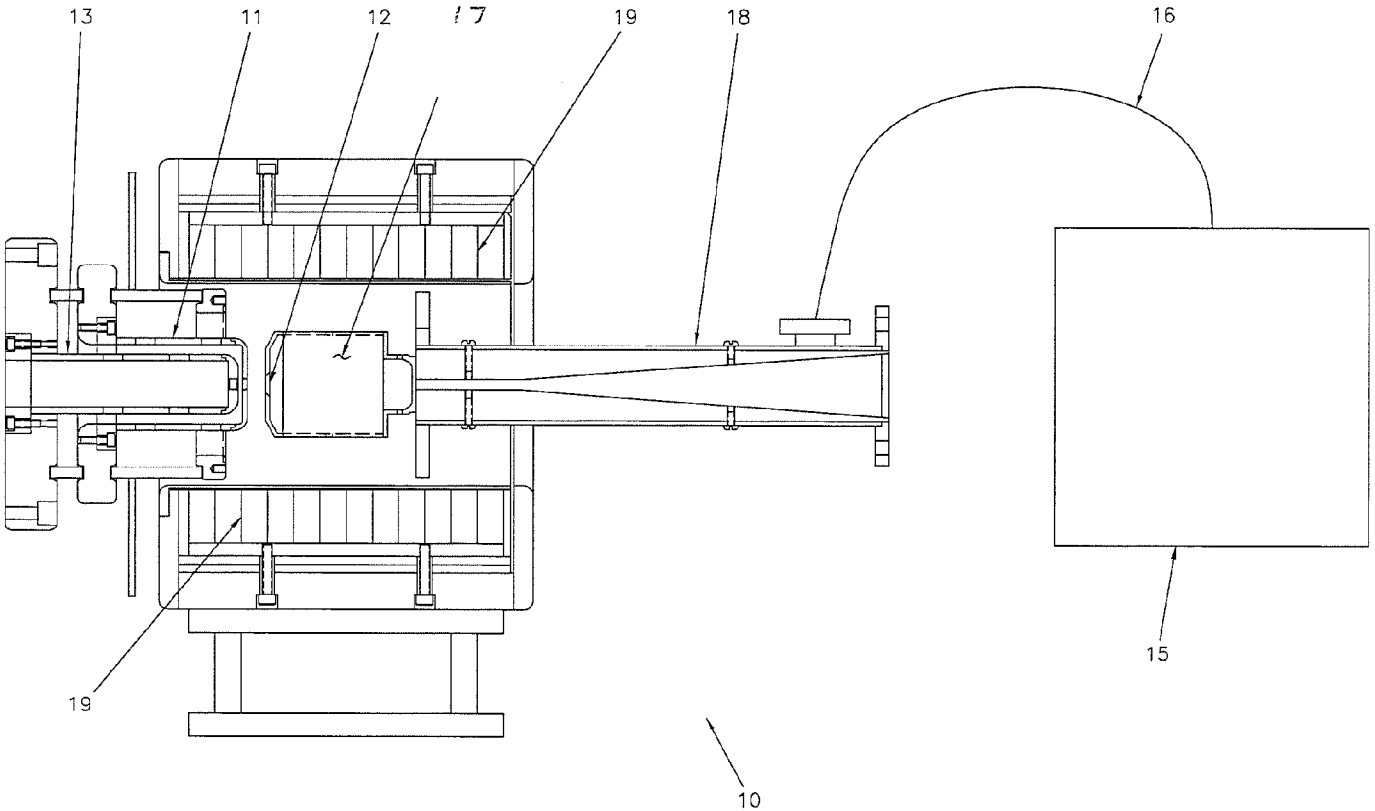
FIGS. 5 and 6 illustrate two views of an embodiment of the ion source of the high-current, high-energy dc proton accelerator.
Figure 6:
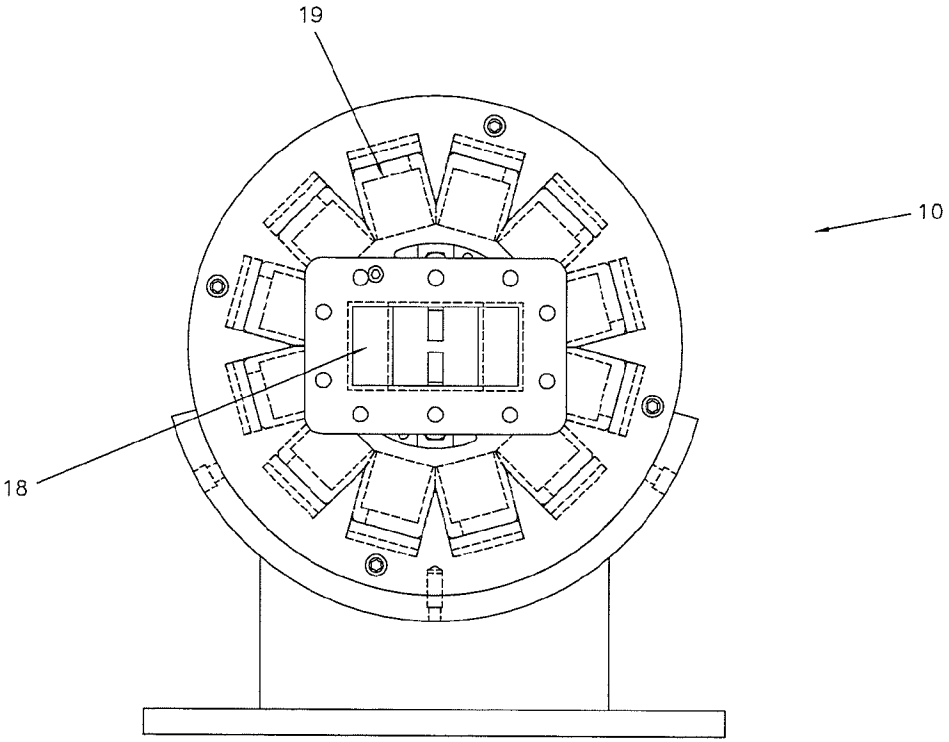

FIGS. 5 and 6 show an embodiment of the proton ion source 10. FIG. 5 shows a side view of the interior and FIG. 6 shows the front view. The proton ion source 10 is capable of providing a high current of protons (about 5 mA or more) while introducing a low amount of residual gas. Preferably, the proton source produces less than about 3 sccm and more preferably, less than 1 sccm, while simultaneously producing the necessary amount of protons. The proton source 10, shown in FIG. 2 has a beam extracting aperture 12 (alternatively referred to as exit aperture), leading to the dipole analyzing magnet 20 and vacuum chamber 40.

In the preferred embodiment, a compact high-current, microwave-driven proton source is utilized. One ion source particularly suitable for use in the inventive system contains a magnetically-confined plasma energized with a microwave drive system (such as that described in J. S. C. Wills, R. A. Lewis, J. Diserens, H. Schmeing, and T. Taylor, A Compact High-Current Microwave-Driven Ion Source, Reviews of Scientific Instruments, Vol. 69, No. 1, 65-68 (1998) incorporated herein by reference). This ion source is different from the Duoplasmatron ion source used in earlier Dynamitrons, which had a short-lived oxide-coated cathode and emitted more molecular hydrogen ions than protons. The solid-state microwave generator 15 can provide up to about 400 watts of power at a frequency of about 2.5 GHz. Thermionic cathodes are not needed in either the ion source or the microwave generator. These features substantially increase the operating time of the proton accelerator before routine maintenance would be needed.

A flexible coaxial cable 16 and a tapered microwave waveguide 18 may be used to transfer microwave power from the generator 15 to the ion source 10. Optionally, permanent magnets 19 are positioned surrounding the ion source 10. The permanent magnets 19 provide an axial magnetic field to confine the plasma so as to reduce its contact with the walls of the source, which would cause a loss of ions. The type of permanent magnet 19 used includes those commonly used in the art and capable of permanent magnetization such as, for example, samarium cobalt or neodymium. FIG. 6 illustrates the placement of the magnets 19 in one embodiment. The dotted lines represent spacers that can be used to change the position of the magnets 19 to change the field.

Other types of ion sources could be used so long as they produce a high proton to residual gas ratio as described above. For example, the ion source could be an Electron Cyclotron Resonance ("ECR") type. This type would require a plasma chamber with a larger diameter for the same microwave frequency, which would, however, increase the cost of the magnetic components.

Typical operating conditions will provide about a 5 to 20 mA proton beam with about 300 watts of microwave power. A mass flow controller (not shown) may be used to feed about 2 sccm of hydrogen gas into the plasma chamber 17 of the ion source 10. Operating conditions will vary significantly depending on the final application of the beam. The hydrogen is typically stored in two small high-pressure tanks (not shown). This quantity of stored gas enables continuous operation of 8 hours per day for about one year. In one embodiment, low-voltage power for the equipment inside the high-voltage terminal is supplied with a rotary electric generator, which is driven with an insulating shaft by a motor at ground potential.

Proton Extraction and Injection System

The hydrogen ions are separated from the plasma and formed into a narrow beam with the strong electric field established between a small-aperture accelerating extraction electrode 11 and the exit aperture 12 of the ion source 10. This aperture is located on the axis of the cylindrical plasma chamber 17 at the end of the ion source 10 opposite the tapered microwave waveguide 18. With a microwave driven proton source such as described above, the proton component will preferably be at least about 60% of the total ion emission. The remainder is mainly diatomic and triatomic hydrogen ions. The voltage applied between the accelerating extraction electrode 11 and the ion source 10 will typically be about 30 kV but could be higher or lower depending on the specific application. A decelerating electrode 13 is located inside and downstream of the extraction electrode 11 to prevent low-energy electrons produced by ion-gas collisions from being drawn back to the ion source. This allows such electrons to accumulate in the extracted ion beam, thereby preventing space charge expansion of the ion beam. A voltage difference of about 1.5 kV to 2.0 kV between the accelerating 11 and decelerating electrodes 13 is sufficient for this purpose The exit aperture 12 leads to the vacuum chamber 40 where the protons are separated from the heavier ions in the primary beam. Separation is preferably accomplished with a dipole analyzing magnet 20 located between the ion source 10 and the accelerating tube 32. This dipole analyzing magnet 20 can be either variable-field electromagnet or a fixed-field permanent magnet. A permanent magnet has the advantage of being smaller and does not require a power supply or control system. The dipole analyzing magnet 20 is configured to produce a field that prevents ions other than the protons produced by the ion source 10, such as diatomic and triatomic hydrogen ions, from reaching the accelerating structure 30. In one embodiment the dipole magnet 20 is at an angle of about 45 degrees, but could be at other angles depending on the application.

Figure 7:
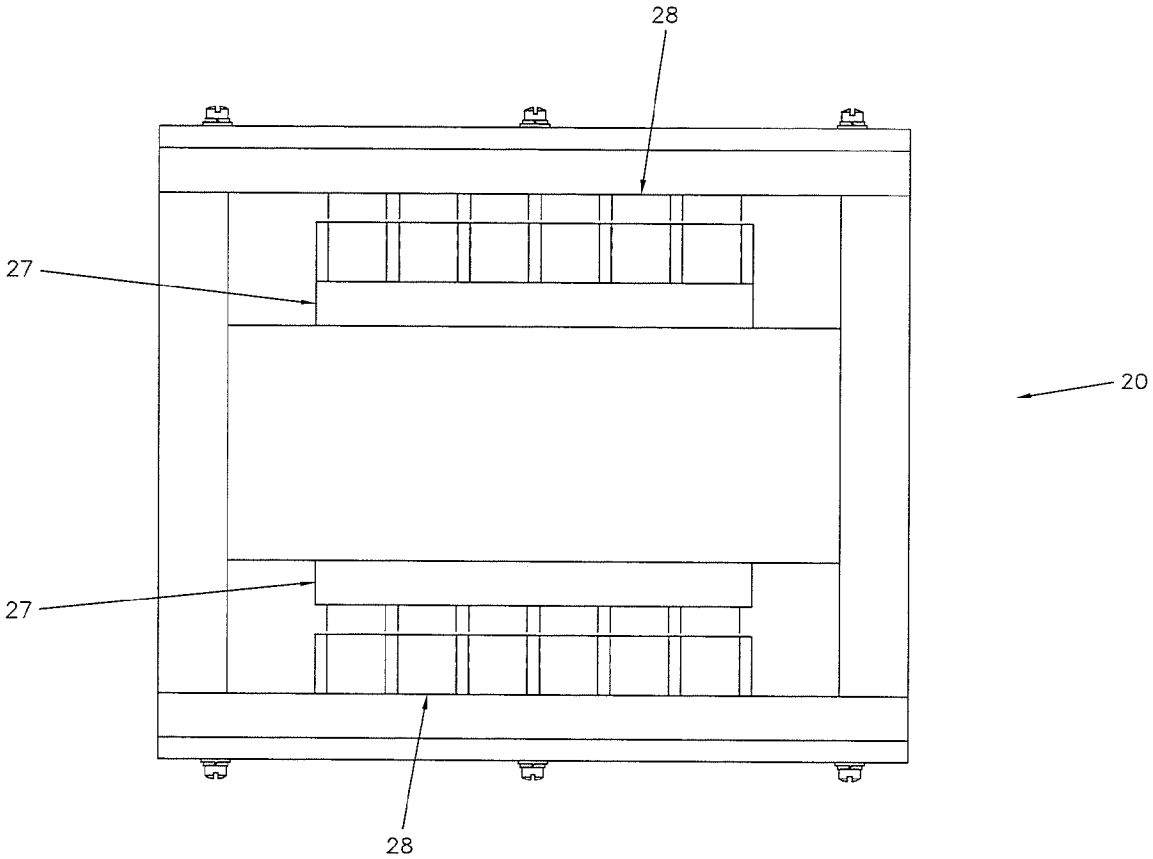
FIGS. 7 and 8 show two views of an embodiment of the dipole analyzing magnet of the high-current, high-energy dc proton accelerator
Figure 8:
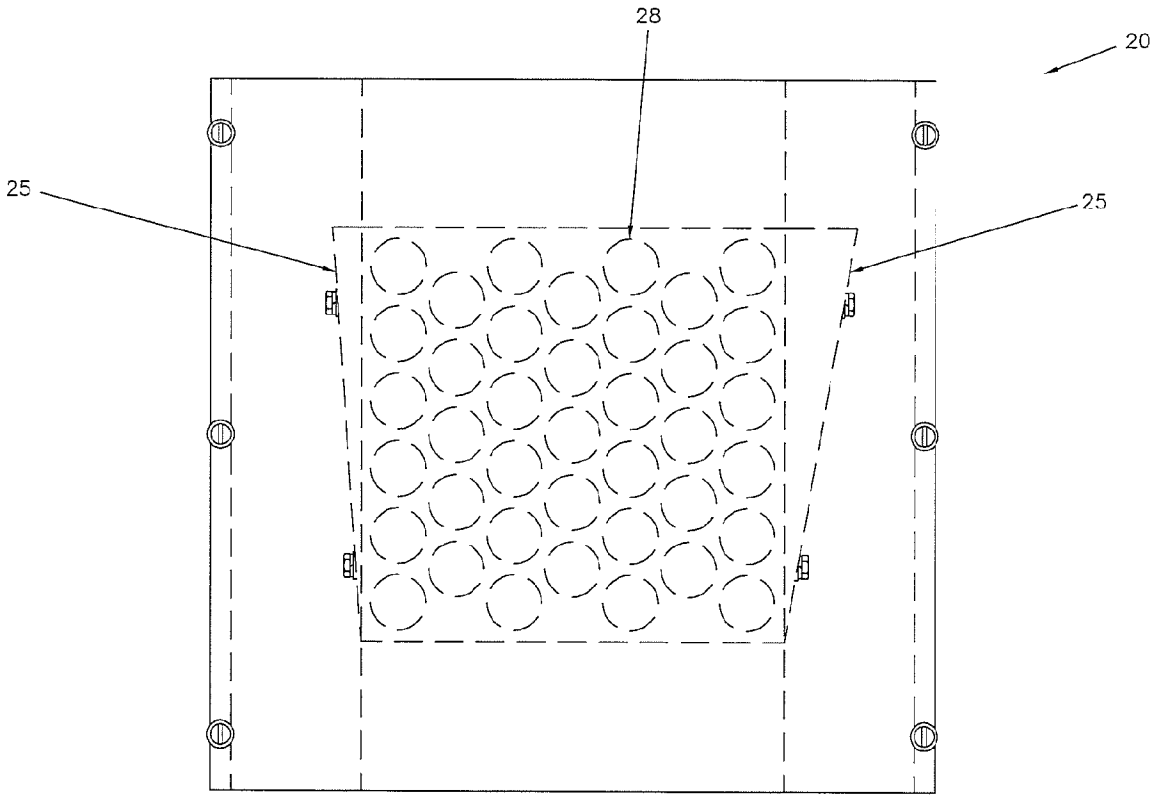

In the preferred embodiment, the dipole analyzing magnet 20 is a fixed field analyzing magnet and is constructed with pieces of permanent magnet material 28 and may include iron pieces to control the shape of the magnetic field. The exact arrangement of the magnet material 28 and/or iron pieces can vary, but one design is illustrated in FIGS. 7 and 8. The magnets 28 are mounted behind a magnetic pole 27 preferably constructed of iron, which functions to provide a uniform magnetic field. The fixed field analyzing magnet 20 may include angled pole tips 25 which produce a focusing effect in both the bending plane and the orthogonal direction to reduce the divergence of the proton beam. In contrast to earlier Dynamitrons, the use of an electrostatic einzel lens and a crossed-field mass analyzer would not be appropriate with a high-current beam because of the need to keep low-energy electrons in the beam to nullify the space-charge expansion effect.

In a preferred embodiment, a vacuum sorption pump 43 is connected to the vacuum chamber 40 which connects the ion source 10 and the accelerating tube 32. The vacuum pump 43 minimizes the flow of neutral gas into the accelerating tube 32. It can be a sorption pump with a high pumping speed for hydrogen gas.

The transverse dimensions of the beam extracted from the ion source were measured. Two actuators extending outward from the beam line were used to pass thin wires through the beam. These actuators were driven by linear gears. The nearly triangular beam profiles produced by the system 1 are shown in FIG. 9.

Figure 9:
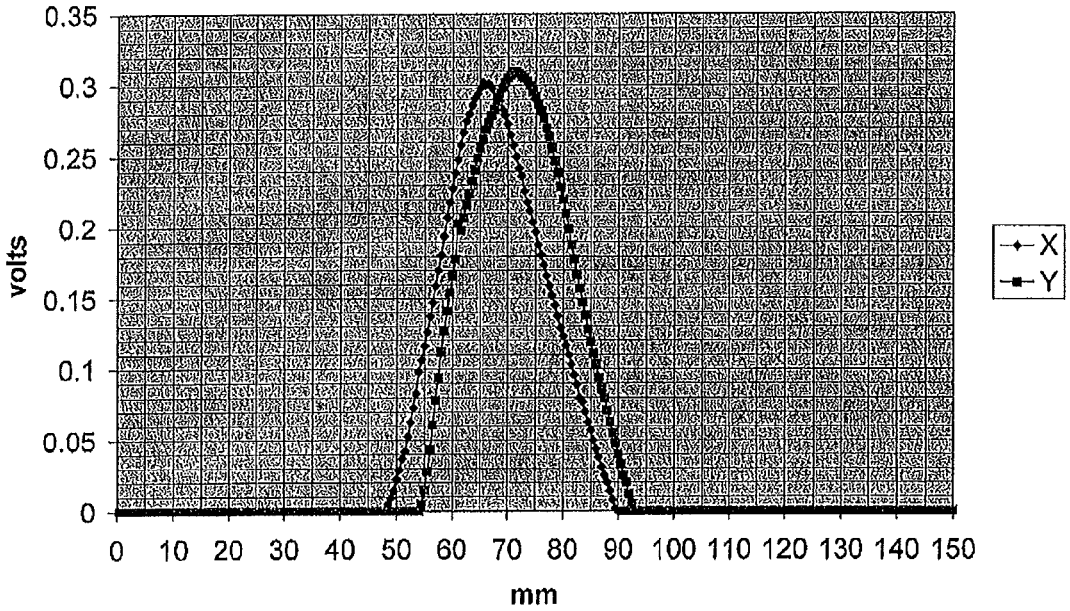
FIG. 9 is a graph showing measurements of the proton beam profiles in the X and Y directions.

When the data in FIG. 9 were taken, the horizontal (X) profile had been offset from the vertical (Y) profile by lowering the extraction voltage slightly to increase the beam deflection in the dipole magnet. This was done just to avoid confusion in displaying both the horizontal and vertical profiles on the same graph. In practice, in the accelerating structure 30 the extraction voltage is adjusted to align the deflected proton beam with the axis of the accelerating tube 32. The slight divergence of the proton beam between the dipole magnet 20 and the accelerating tube 32 is compatible with the focusing effect of the protruding electric field at the entrance to the accelerating tube 32. Computer simulations show that the beam profile will be changed from divergent to convergent as it enters the accelerating tube 32. The beam will be nearly parallel during acceleration by the uniform electric field in the accelerator column 32, so that it will not strike the large apertures of the metallic dynodes 35 (alternatively referred to as "accelerating electrodes") of the accelerating tube 32 (described in more detail below). Under these conditions, the beam diameter will be less than about 2 cm at the exit of the accelerating tube 32. The diameter of the exiting beam can be adjusted with the magnetic quadrupole doublet lens, which is located at the base of the accelerating tube 32.

Optionally, at or near the exit of the dipole analyzing magnet 20, and before the entrance of the accelerating tube 32, there is a small metallic aperture 36, as best shown in FIGS. 3 and 4. This aperture 36 has a diameter that is smaller than the diameter of the interior of the dynodes 35 of the accelerating tube 32. The aperture 36 reduces the amount of neutral gas entering the accelerating tube 32. In addition, the aperture 36 functions to limit the divergence of the beam that can be drawn into the accelerating tube 32 so that the accelerating protons cannot strike the dynodes 35 in the accelerating tube 32.

In an especially preferred embodiment the diameter of the aperture 36 is about 1 inch and the interior diameter of the conducting dynodes 36 is about 3 inches. The aperture 36 is especially useful when used in combination with the vacuum pump 43 described above. Neutral gases exiting the proton source should be minimized as much as possible. The neutral gases can either be evacuated by the sorption pump 43 or they can go into the accelerating column 32. When used in combination with the sorption pump, the aperture 36, which is located downstream from this pump 43, causes a higher percentage of the neutral gas to be removed and a better vacuum is achieved in the accelerating tube 32.

Direct Current Accelerating Structure

The preferred proton accelerator structure 30 shown in FIGS. 1 and 2 is based on the Dynamitron design; however other dc accelerator designs may be used, such as a Cockcroft-Walton series-coupled cascade rectifier system or a magnetically coupled cascade rectifier system. Referring to FIG. 1, the high-voltage DC power supply 50 consists of a parallel-coupled, cascaded-rectifier assembly that surrounds the acceleration column 32. The rectifier assembly 38 can be energized, for example, with a self-tuning RF oscillator circuit resonating at a frequency of about 100 kHz (such as that described in M. R. Cleland, J. P. Farrell, Dynamitrons of the Future, IEEE Transactions on Nuclear Science, Vol. NS-12, No. 3, 227-234 (1965) incorporated herein by reference).

In one embodiment, the rectifier assembly 38 has 60 solid-state rectifiers in the cascade circuit, each contributing 50 kV at maximum voltage. This rectifier assembly is able to generate a DC potential of 3 MV and deliver a continuous electron beam current of 50 mA or a beam power of 150 kW (for one example, a design is described in M. R. Cleland, K. H. Morgenstern and C. C. Thompson, H. F. Malone, High-Power Electron dc Electron Accelerators for Industrial Applications, 3$^{rd}$ All-Union Conference on Applied Accelerators, Leningrad, USSR (Jun. 26-28, 1977) incorporated herein by reference). Other designs of the rectifier assembly are possible. More or less solid-state rectifiers can be used depending on the desired voltage of the acceleration system 1.

In the embodiment shown, the accelerating tube 32 has an active length of 240 cm (about 8 ft) and the internal diameter of the apertures in the dynodes 35, is about 7.5 cm (about 3 in). Again, the length and internal diameter can be changed according to the specific application. The dynodes 35, as best shown in FIGS. 3 and 4, are convoluted to prevent scattered particles from striking insulating rings. The insulating rings, which support and separate the dynodes 35, are preferably constructed of glass. In the figures, only a portion of the total number of dynodes and insulating rings are shown so as not to obscure the other component. Small permanent magnets may be attached to some of the intermediate dynodes 35 to prevent secondary electrons emitted by ion-gas collisions inside the accelerating tube 32 from accelerating backward toward the high-voltage terminal. Such magnets substantially reduce the generation of X-rays by such electrons.

In the embodiment shown, the accelerating tube 32 is mounted coaxially inside the power supply 50, in this instance a high-voltage generator. The preferred high voltage power supply is a Dynamitron. However, the high voltage power supply 50 can be configured differently as long as it is a high voltage and high current power supply. The power supply 50 provides accelerating voltage to the accelerating tube 32 and can be connected by the various ways known to those in the art. Preferably, the power supply 50 is capable of at least about 0.3 MV or more and about 5 mA or more.

Upon exiting the acceleration tube 32, the beam is preferably scanned in order to reduce the power density of the beam. In one embodiment, the beam exits the acceleration column 32 to a scan magnet. The beam is preferably spread on a relatively large surface as compared to the primary small-diameter beam. In one embodiment, the scan magnet includes a pair of orthogonal scanning magnets, preferably one in the X direction and one in the Y direction, with dimensions of about 1 square meter. In another embodiment, the beam is spread on the surface of a target coated with thin layer of lithium for the production of neutrons.

External Beam Transport System

For BNCT applications, the accelerated proton beam may be directed to either of two targets for the production of neutrons. One target is mounted on a rotating gantry for treating cancer patients from different directions. The other is mounted in a fixed location for treatments that do not require the use of the rotating gantry. A dipole magnet located on the axis of the accelerator enables the operator to switch the beam from one target to the other. A magnetic quadrupole lens located inside the pressure vessel near the base of the accelerating tube 32 is the first component of the complex beam transport system.

Other targets may be used for other applications.

Lithium Target Assembly

A thin layer of lithium metal is deposited on the inner surfaces of two water-cooled metallic panels. These panels are mounted at about 30 degrees with reference to the symmetry axis of the proton beam, which is scanned in the X and Y directions to cover the surfaces of both panels. The tilting of these panels increases the area of the target material to enhance cooling the lithium coating. The lithium thickness is just sufficient to reduce the incident proton energy to 1.89 MeV, which is the threshold energy of the $^{7}Li(p,n)^{7}Be$ reaction for producing neutrons. A greater thickness would increase the energy deposited in the lithium layer without increasing the neutron yield. The lithium is deposited on thin plates of iron, as shown in FIG. 5. Iron is a material that resists the formation of hydrogen blisters from the protons that pass through the lithium layer and stop in the backing material. The back sides of the thin iron plates have cooling fins, which are bonded to thick water-cooled copper panels for efficient heat removal. The iron plates prevent the protons from reaching the copper panels, which are likely to form hydrogen blisters. The lithium layer is covered with a very thin layer of stainless steel to protect it from degradation by exposure to moist air. A detailed description of this target assembly is provided in Y. Jongen, F. Stichelbaut, A. Cambriani, S. Lucas, F. Bodart, A. Burdakov, Neutron Generating Device for Boron Neutron Capture Therapy, International Patent Application No. WO 2008/025737 A1, the entire contents of which are incorporated herein by reference.

Neutron Beam Shaping Assembly

The assembly consists of a central moderator of magnesium fluoride surrounded by a neutron reflector, a delimiter and a filter made of different materials. Its main purpose is to reduce the neutron energy spectrum so that the maximum energy does not exceed about 20 keV. This allows the irradiation of the lithium target with proton beam energies several hundred keV above the threshold energy to increase the neutron yield. It also limits the diameter of the neutron beam to concentrate the absorbed dose on the tumor site. A more detailed description of this beam shaping assembly is described in Y. Jongen, F. Stichelbaut, A. Cambriani, S. Lucas, F. Bodart, A. Burdakov, Neutron Generating Device for Boron Neutron Capture Therapy, International Patent Application No. WO 2008/025737 A1, the contents of which are incorporated herein by reference.

Alternatives

There will be various modifications, adjustments, and applications of the disclosed invention that will be apparent to those of skill in the art, and the present application is intended to cover such embodiments. Accordingly, while the present invention has been described in the context of certain preferred embodiments, it is intended that the full scope of these be measured by reference to the scope of the following claims.

What is claimed is:

1. An accelerator system able to accelerate high currents of proton beams at high energies comprising:

a dc accelerating structure to accelerate the proton beam;

a high voltage, high current power supply providing accelerating voltage to said accelerating structure;

a proton ion source having a beam extraction aperture, wherein the proton ion source releases less than 3 SCCM of neutral hydrogen gas through the beam extraction aperture;

a dipole analyzing magnet located between the ion source and the accelerating structure.

2. An accelerating system as in claim 1, further comprising a vacuum pump connected to the vacuum chamber connecting the ion source and the accelerating structure.

3. An accelerating system as in claim 1, where the high voltage power supply is a Dynamitron structure.

4. An accelerating system as in claim 1, where the ion source utilizes microwaves to ionize the gas.

5. An accelerating system as in claim 4 where the ion source uses Electron Cyclotron Resonance to ionize the gas.

6. An accelerating system as in claim 1, where the dipole analyzing magnet is comprised is a fixed field analyzing magnet.

7. An accelerating system as in claim 6, where the fixed field analyzing magnet is designed to be doubly focusing.

8. An accelerating system as in claim 1, wherein the accelerating structure comprises an accelerating column and pieces of permanent magnet material placed around the accelerating column positioned to prevent secondary electrons to be accelerated backward in the accelerating column.

9. An accelerating system as in claim 1, where an aperture is placed at the entrance of the accelerating structure.

10. An accelerating system as in claim 2 further comprising an aperture placed at the entrance of the accelerating structure.

11. An accelerating system as in claim 1, where the accelerated beam is spread on a receiving surface of at least 1 square meter by a pair of orthogonal scanning magnets scanning the beam on the receiving surface.

* * * * *